US009842683B1

(12) United States Patent
LeBlanc et al.

(10) Patent No.: US 9,842,683 B1
(45) Date of Patent: Dec. 12, 2017

(54) BOBBIN AND E-CORE ASSEMBLY CONFIGURATION AND METHOD FOR E-CORES AND EI-CORES

(71) Applicant: Universal Lighting Technologies, Inc., Madison, AL (US)

(72) Inventors: Mike LeBlanc, Huntsville, AL (US); Donald Folker, Madison, AL (US)

(73) Assignee: UNIVERSAL LIGHTING TECHNOLOGIES, INC., Madison, AL (US)

( * ) Notice: Subject to any disclaimer, the term of this patent is extended or adjusted under 35 U.S.C. 154(b) by 34 days.

(21) Appl. No.: 14/923,509

(22) Filed: Oct. 27, 2015

Related U.S. Application Data

(60) Provisional application No. 62/074,749, filed on Nov. 4, 2014.

(51) Int. Cl.

| | |
|---|---|
| ***H01F 27/30*** | (2006.01) |
| ***H01F 7/06*** | (2006.01) |
| ***H01F 27/32*** | (2006.01) |
| ***H01F 41/02*** | (2006.01) |

(52) U.S. Cl.
CPC ..... *H01F 27/325* (2013.01); *H01F 41/0206* (2013.01)

(58) Field of Classification Search
CPC ..... H01F 27/06; H01F 3/14; H01F 27/022
USPC ..... 336/198, 199, 200; 29/602.1
See application file for complete search history.

(56) References Cited

U.S. PATENT DOCUMENTS 4,347,490 A * 8/1982 Peterson ..... H01F 27/06 336/192
4,503,413 A * 3/1985 Stalzer ..... H01F 27/29 336/192
5,898,354 A * 4/1999 Lee ..... H01F 27/022 336/192
6,060,975 A * 5/2000 Rowe ..... H01F 27/325 336/192
6,326,874 B1 * 12/2001 Banzi, Jr. ..... H01F 5/04 336/192
6,611,190 B2 * 8/2003 Chui ..... H01F 27/306 336/145

(Continued)

OTHER PUBLICATIONS

Product Description for Model 6634073800 Bobbin, Cixi Sinuo Electronics Co., Ltd., No. 56 Lixin Road, Zhonghan Street, Cixi, ZheJiang, China, May 9, 2011, 1 page.

*Primary Examiner* — Elvin G Enad
*Assistant Examiner* — Joselito Baisa
(74) *Attorney, Agent, or Firm* — Patterson Intellectual Property Law, P.C.; Mark J. Patterson; Jerry Turner Sewell

(57) ABSTRACT

A magnetic assembly includes a bobbin and first and second cores. Each core has a main body. At least one of the cores has first and second outer legs and a center leg extending from the main body. The bobbin includes a first channel on a first end flange and a second channel on a second end flange. Each channel includes a plurality of crushable ribs that extend into the channel. The first and second cores are inserted into the respective first and second channels to engage and crush the crushable ribs. The crushed ribs frictionally engage the main bodies of the two cores to retain the two cores in a fixed relationship with the bobbin without requiring tape or glue. In one embodiment, both cores are E-cores. In another embodiment, one core is an extended E-core and the other core is an I-core.

10 Claims, 10 Drawing Sheets

(56) References Cited

U.S. PATENT DOCUMENTS

| | | | | |
|---|---|---|---|---|
| 6,734,777 | B2 * | 5/2004 | Yeh | H01F 27/324 336/198 |
| 6,771,157 | B2 * | 8/2004 | Nishikawa | H01F 3/14 336/178 |
| 6,958,673 | B2 * | 10/2005 | Suzuki | H01F 27/022 336/198 |
| 6,959,798 | B2 * | 11/2005 | Danley | F16F 15/00 188/371 |
| 7,046,111 | B2 * | 5/2006 | Sigl | H01F 3/14 336/178 |
| 7,106,160 | B2 * | 9/2006 | Tsergas | H01F 5/04 336/192 |
| 7,205,825 | B2 * | 4/2007 | Klein | H01L 29/78615 257/E29.281 |
| 8,116,089 | B1 * | 2/2012 | Folker | H05K 7/12 174/262 |
| 8,406,007 | B1 * | 3/2013 | Folker | H01F 27/06 361/719 |
| 2004/0036003 | A1 * | 2/2004 | Danley | F16F 15/00 248/638 |
| 2004/0246685 | A1 * | 12/2004 | Barron | G01P 1/026 361/752 |

* cited by examiner

BOBBIN AND E-CORE ASSEMBLY CONFIGURATION AND METHOD FOR E-CORES AND EI-CORES

CROSS-REFERENCES TO RELATED APPLICATIONS

This application claims benefit of the following patent application which is hereby incorporated by reference: U.S. Provisional Patent Application No. 62/074,749 filed Nov. 4, 2014, entitled "Bobbin and E-Core Assembly Configuration and Method for a Magnetic Component."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

Conventionally, E-cores used on a magnetic assembly are held together with tape or glue. The E-cores must be held in place during assembly until the tape is secured or until the glue is dried. Adding tape or glue to restrain the E-cores requires additional steps during an assembly process and adds cost to the manufacturing process. Accordingly, a need exists for a low-cost bobbin and core assembly method for E-cores that does not require taping or gluing the cores together.

BRIEF SUMMARY OF THE INVENTION

A novel bobbin and core assembly method uses only the bobbin to secure the cores together. The bobbin has a channel on each end flange of the bobbin. The channels are perpendicular to a passageway through the bobbin. Each channel has a plurality of crushable ribs that extend outward from the respective end flange and that extend into the respective channel. In an embodiment, eight crushable ribs extend into each channel with four ribs proximate to the top of the channel and with four ribs proximate to the bottom of the channel.

The two E-cores are inserted into the bobbin passageway from opposite ends of the bobbin. The two E-cores are moved inwardly until the end surfaces of the outer legs of the two E-cores meet along the outside of the bobbin. The center leg of at least one of the E-cores is shorter than the outer legs to provide a gap between the center leg of the E-core and the other center leg. The two E-cores are secured to the bobbin by frictional engagement of the main bodies of the E-cores with the crushable ribs in the two channels. The bobbin structure and the method of assembling the cores can be used on cores with round, oval, square or rectangular center legs. The bobbin and the method can also be used for EI-core assemblies having one extended E-core with its center leg inserted into the bobbin passageway from one end of the bobbin and having an I-core adjacent the ends of the legs of the E-core in the channel at the opposite end of the bobbin. In either embodiment, the crushable ribs engage the two core bodies and restrain the two core bodies so that no taping or gluing is required. The labor required to assemble the magnetic component is reduced, and no tape or glue is required. The structure and the method of assembly require less material and labor to secure the E-cores together. Accordingly, labor and material costs are reduced.

An aspect of the invention in accordance with embodiments disclosed herein is a magnetic assembly that includes a bobbin and first and second cores. Each core has a main body. At least one of the cores has first and second outer legs and a center leg extending from the main body. The bobbin includes a first channel on a first end flange and a second channel on a second end flange. Each channel includes a plurality of crushable ribs that extend into the channel. The first and second cores are inserted into the respective first and second channels to engage and crush the crushable ribs. The crushed ribs frictionally engage the main bodies of the two cores to retain the two cores in a fixed relationship with the bobbin without requiring tape or glue. In one embodiment, both cores are E-cores. In another embodiment, one core is an extended E-core and the other core is an I-core.

Another aspect of the invention in accordance with embodiments disclosed herein is a magnetic assembly. The magnetic assembly includes a bobbin, a first core and a second core. The bobbin includes a first outer flange and a second outer flange. A passageway extends through the bobbin from the first outer flange to the second outer flange. At least one winding is wound about the passageway. The bobbin further includes a first plurality of crushable ribs extending outward from the first outer flange in a first channel and a second plurality of crushable ribs extending outward from the second outer flange in a second channel.

The first core has a main body and has a first outer leg, a second outer leg, and a center leg extending from the main body. The center leg has an end surface. The center leg of the first core is positioned in the passageway of the bobbin with at least a portion of the main body of the first core positioned in the first channel in crushing frictional engagement with the first plurality of ribs. The second core has a main body. At least a portion of the main body of the second core is positioned in the second channel in crushing frictional engagement with the second plurality of crushable ribs. A facing surface of the second core is positioned proximate to the end surface of the center leg of the first core.

In certain embodiments in accordance with this aspect of the invention, the second core is an I-core. In other embodiments in accordance with this aspect of the invention, the second core is an E-core having a first outer leg, a second outer leg, and a center leg. The facing surface of the second core is an end surface of the center leg of the second core. In certain embodiments, each crushable rib has a first thickness at a first end proximate to the respective outer flange and a second thickness at a second end displaced away from the respective outer flange. The second thickness is less than the first thickness. The crushable rib has an engagement surface that slopes between the first end and the second end. The engagement surface engages the main body of the respective core.

In certain embodiments, the first plurality of crushable ribs includes at least a first rib positioned above the main body of the first core and a second rib positioned below the main body of the core. The first and second ribs are spaced apart vertically such that the respective second ends of the first and second ribs are spaced apart by a distance greater than the height of the main body of the core and the respective first ends of the first and second ribs are spaced apart by a distance less than the height of the main body of the core. In some embodiments, the first rib is positioned on a lower surface of a ledge extending from the first outer flange, and the second rib is positioned on an upper surface of a connector rail.

Another aspect of the invention in accordance with embodiments disclosed herein is a bobbin for a magnetic assembly. The bobbin includes a first outer flange and a second outer flange. A passageway extends through the bobbin from the first outer flange to the second outer flange. At least one winding is wound about the passageway. A first plurality of crushable ribs extends outward from the first outer flange with at least a first of the first plurality of crushable ribs positioned at a level near the top of the passageway and with at least a second of the first plurality of crushable ribs positioned at a level near the bottom of the passageway. A second plurality of crushable ribs extends outward from the second outer flange with at least a first of the second plurality of crushable ribs positioned at a level near the top of the passageway and with at least a second of the second plurality of crushable ribs positioned at a level near the bottom of the passageway. In certain embodiments, the first rib of the first plurality of crushable ribs is mounted on a first connector rail extending from the first outer flange, and the second rib of the first plurality of crushable ribs is mounted on a ledge extending from the first outer flange. In certain embodiments, the first rib of the second plurality of crushable ribs is mounted on a second connector rail extending from the second outer flange, and the second rib of the second plurality of crushable ribs is mounted on a ledge extending from the second outer flange.

Another aspect of the invention in accordance with embodiments disclosed herein is a method of assembling a magnetic assembly. The method includes positioning the center leg of an E-core into a passageway of a bobbin with a first outer leg of the E-core positioned on a first side of the bobbin, with a second outer leg of the E-core positioned on a second side of the bobbin, and with a main body of the E-core positioned in a first channel between upper and lower crushable ribs extending from a first end flange of the bobbin. The crushable ribs extending from the first end flange frictionally engage the main body to secure the first E-core to the bobbin. The method further includes positioning a second core on the bobbin with at least a portion of a main body of the second core positioned in a second channel between upper and lower crushable ribs extending from a second end flange of the bobbin. The crushable ribs extending from the second end flange frictionally engage the portion of the main body of the second core to secure the second core to the bobbin.

In certain embodiments of the method, the E-core is a first E-core and the second core is a second E-core. The second E-core has a center leg. The method further includes positioning the center leg of the second E-core in the passageway of the bobbin. The center leg of the second E-core has an end surface. The end surface of the center leg of the second E-core is spaced apart from an end surface of the center leg of the first E-core to form a magnetic gap. In certain embodiments, the E-core is an extended E-core having outer legs that extend from the first end flange to the second end flange of the bobbin and having a center leg positioned in the passageway with an end surface of the center leg near the second end flange. The second core is an I-core. The method further includes positioning a central facing surface of the I-core proximate to and spaced apart from the end surface of the center leg of the extended E-core to form a magnetic gap.

DETAILED DESCRIPTION OF THE INVENTION

In the following description, various dimensional and orientation words, such as height, width, length, longitudinal, horizontal, vertical, up, down, left, right, tall, low profile, and the like, may be used with respect to the illustrated drawings. Such words are used for ease of description with respect to the particular drawings and are not intended to limit the described embodiments to the orientations shown. It should be understood that the illustrated embodiments can be oriented at various angles and that the dimensional and orientation words should be considered relative to an implied base plane that would rotate with the embodiment to a revised selected orientation.

Figure 1:
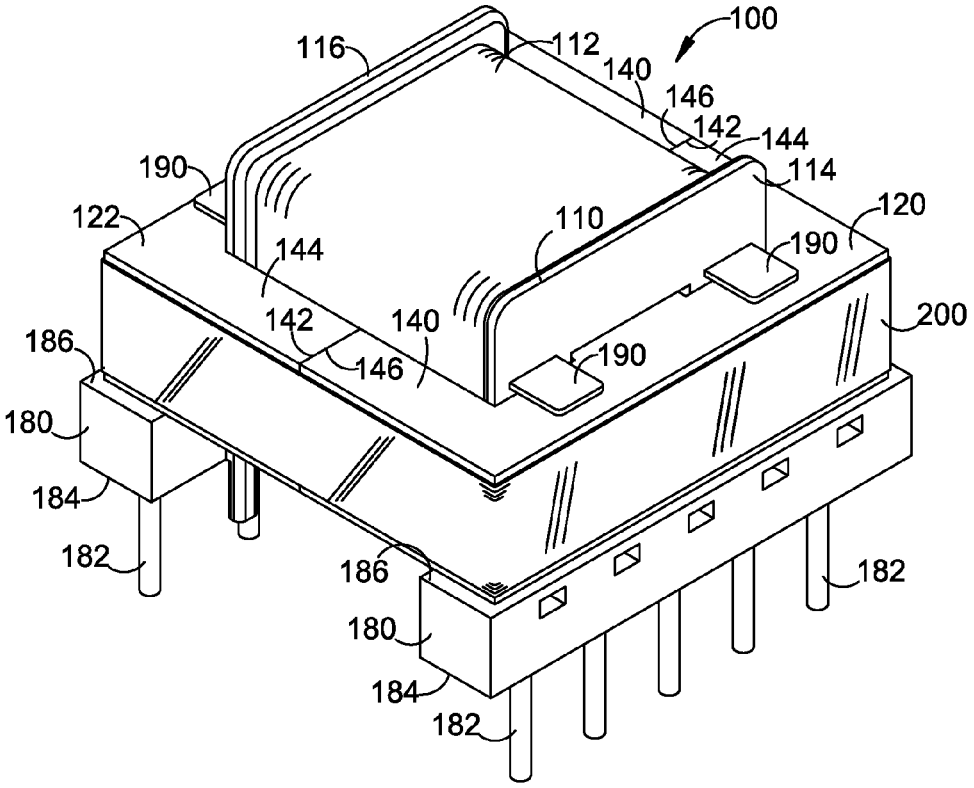
FIG. 1 (Prior Art)
FIG. 1 illustrates a perspective view of a conventional magnetic assembly having a bobbin with a coil wound around the bobbin and with two E-cores inserted into a passageway through the bobbin.
Figure 3:
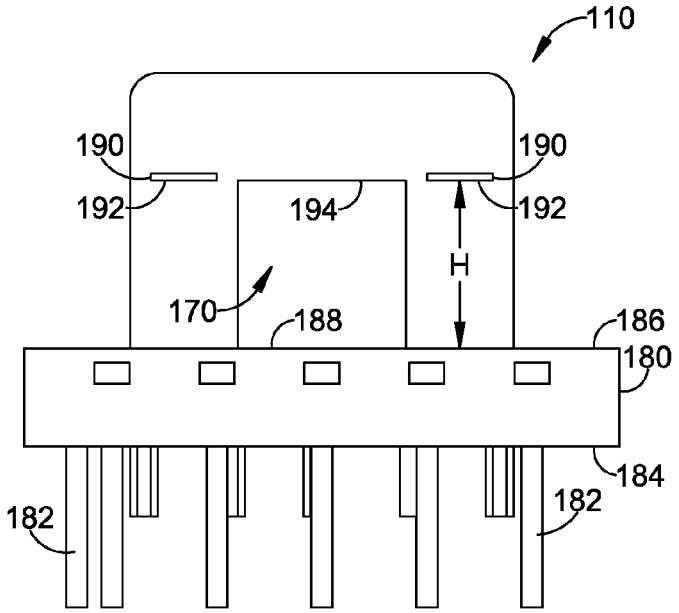
FIG. 3 (Prior Art)
FIG. 3 illustrates a front elevational view of the bobbin of FIG. 2.
Figure 2:
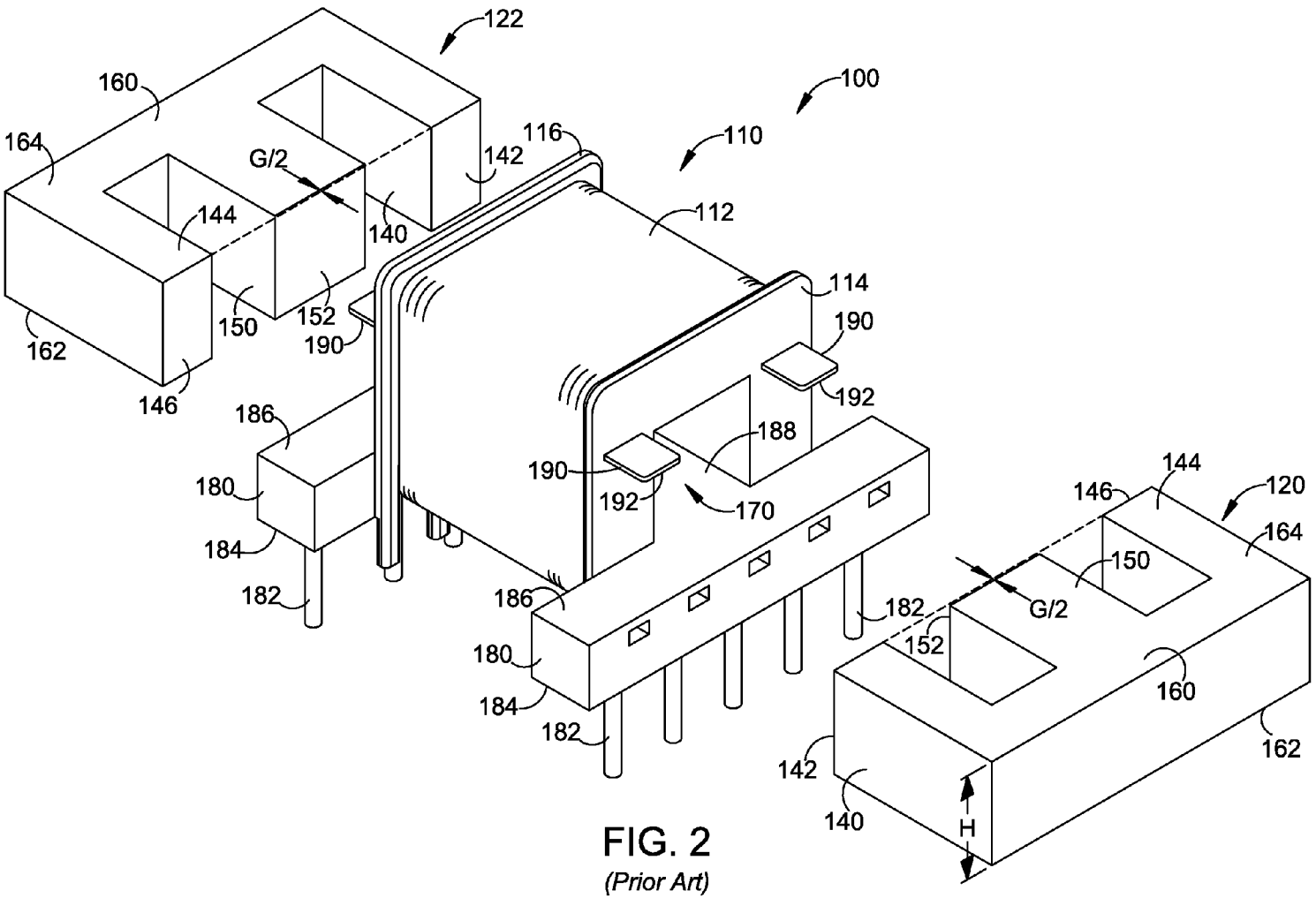
FIG. 2 (Prior Art)
FIG. 2 illustrates an exploded perspective view of the conventional magnetic assembly of FIG. 1.

FIG. 1 illustrates a perspective view of a conventional magnetic assembly 100 having a bobbin 110 with a coil or winding 112 wound around the bobbin 110 between a first end flange 114 and a second end flange 116. The magnetic assembly 100 further includes a first E-core 120 and a second E-core 122. FIG. 2 illustrates an exploded perspective view of the bobbin assembly of FIG. 1. FIG. 3 illustrates a front elevational view of the bobbin of FIG. 2.

As shown in FIG. 2, each of the E-cores 120, 122 includes a first outer leg 140 having an end surface 142, a second outer leg 144 having an end surface 146, and a center leg 150 having an end surface 152. The outer legs and the center leg of each E-core extend perpendicularly from a common body portion 160 having a lower surface 162 and an upper surface 164. The center leg 150 of each E-core is aligned with a passageway 170 through the bobbin between the first end flange 114 and the second end flange 116. The center legs are inserted into the passageway 170 from opposite ends to form the assembled configuration shown in FIG. 1. In many configurations, the center leg of each E-core is shorter than the outer legs of the E-core by a small difference (G/2) such that when the center legs of the two E-cores are positioned in the passageway of the bobbin from opposite ends of the bobbin, the end surfaces of the outer legs abut and the end surfaces of the center legs are spaced apart by a total difference (G) to form a gap between the end surfaces. The gap controls saturation of the core in a known manner.

As further shown in FIGS. 1-3, the bobbin 110 includes a connector rail 180 at each end of the bobbin. Each connector rail 180 has a plurality of connector pins 182 extending from a lower surface 184. Some or all of the connector pins 182 are electrically connected to the winding 112 by conductors (not shown). Each connector rail 180 has an upper surface 186. In the illustrated embodiment, the upper surface 186 of each connector rail 180 extends to and is level with a bottom surface 188 of the passageway 170 of the bobbin.

Each of the first end flange 114 and the second end flange 116 of the bobbin 110 includes a plurality of tabs 190. The tabs 190 extend perpendicularly from the respective flange 114, 116. As shown in FIG. 3, each tab 190 has a respective lower surface 192, which is generally aligned with an upper surface 194 of the passageway 170 of the bobbin. The lower surface 192 of each tab 190 is spaced apart from the upper surface 186 of the connector rail 180 at the respective end of the bobbin 110 by a distance (H) selected to be substantially equal to the height of the common body portion 160 of each of the E-cores 120, 122 between the respective lower surface 162 and the respective upper surface 164 of the common body portion. Thus, when the magnetic assembly is assembled as shown in FIG. 1, the common body portions of the E-cores fit between the lower surfaces of the tabs and the upper surfaces of the connector rails to position the E-cores vertically with respect to the passageway of the bobbin.

Although the two E-cores 120, 122 are constrained vertically between the tabs 190 and the connector rails 180, the E-cores are not constrained horizontally. Thus, the conventional magnetic assembly 100 of FIGS. 1-3 further includes at least one layer of an adhesive tape 200 that is wrapped around the common body portions 160 and the outer legs 140, 144 of the two E-cores after the E-cores are positioned with the respective end surfaces 142, 144 of the outer legs of one E-core abutting the respective end surfaces 146, 142 of the outer legs of the other E-core. Preferably, multiple layers of the adhesive tape 200 are wound around the E-cores. Alternatively, the end surfaces of the outer legs are glued and the E-cores are held securely in place until the glue sets to permanently engage the end surfaces. In addition, in some embodiments, the lower surfaces 162 and the upper surfaces 164 of the common body portions 160 of the E-cores may be taped or glued to the connector rails and the tabs, respectively, to further secure the E-cores. In either case, the additional steps of taping or gluing require time and effort, and the glue and tape require additional materials. The additional steps and material increase the cost of producing the magnetic assembly 100.

Figure 4:
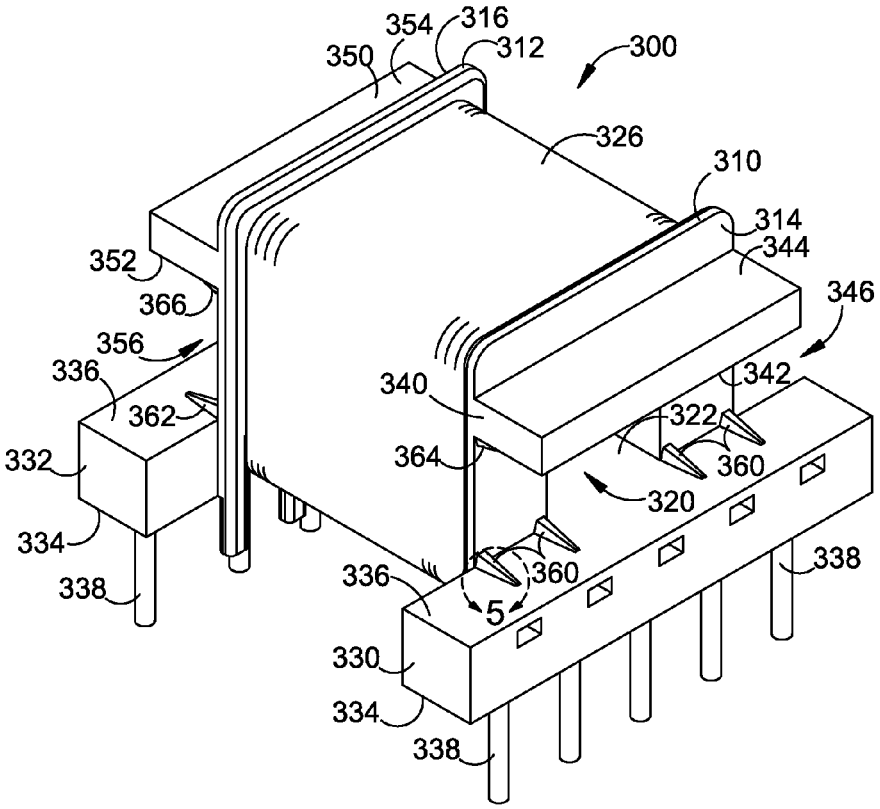
FIG. 4 illustrates a perspective view of an embodiment of a bobbin for a magnetic assembly in accordance with aspects of the present invention, the bobbin having a plurality of upper and lower ribs extending into channels formed on the end flanges of the bobbin.
Figure 5:
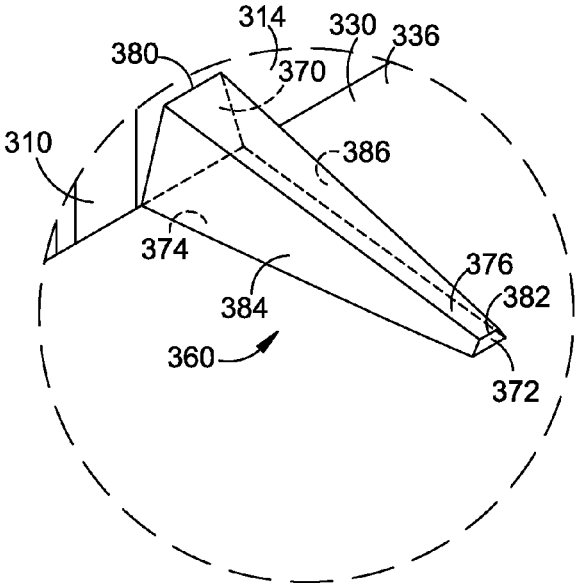
FIG. 5 illustrates an enlarged perspective view of one of the lower ribs of FIG. 4 taken within the area --5-- in FIG. 4.
Figure 6:
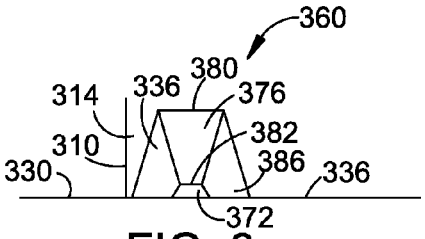
FIG. 6 illustrates an enlarged front elevational view of the lower rib of FIG. 5.
Figure 7:
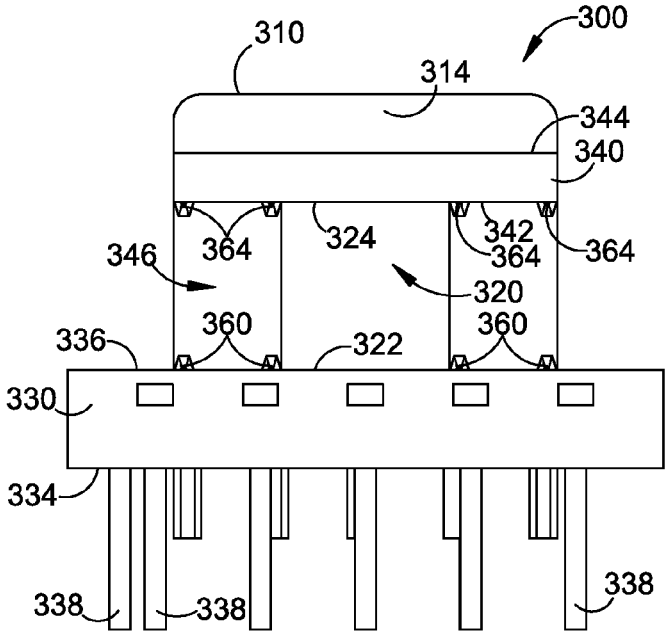
FIG. 7 illustrates a front elevational view of the improved bobbin of FIG. 4.
Figure 8:
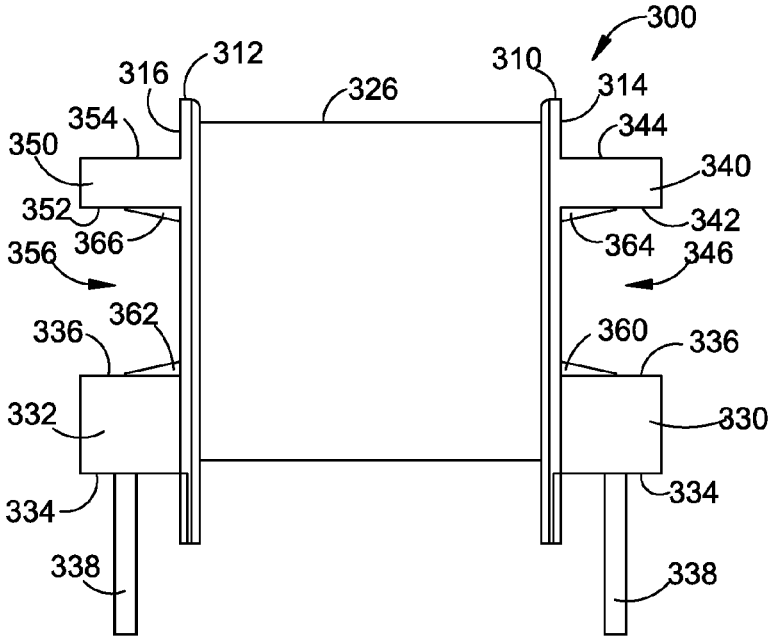
FIG. 8 illustrates a side elevational view of the improved bobbin of FIG. 4.

FIG. 4 illustrates a perspective view of an embodiment of a bobbin 300 for a magnetic assembly that reduces the time, effort and materials for producing a magnetic assembly. FIG. 5 illustrates an enlarged perspective view of one of the lower ribs of FIG. 4 taken within the area --5-- in FIG. 4. FIG. 6 illustrates an enlarged front elevational view of the lower rib of FIG. 5. FIG. 7 illustrates a front elevational view of the bobbin of FIG. 4. FIG. 8 illustrates a side elevational view of the bobbin of FIG. 4.

The bobbin 300 of FIGS. 4-8 includes a first end flange 310 and a second end flange 312. The first end flange has a first outer surface 314. The second end flange has a second outer surface 316. A passageway 320 extends through the bobbin from the first outer surface of the first end flange to the second outer surface of the second end flange. The passageway has a lower inner surface 322 and an upper inner surface 324 (FIG. 7). A winding 326 is wound about the passageway 320 between the first and second end flanges. In the illustrated embodiment, the bobbin 300 may be formed of nylon, such as, for example, commercially available Nylon 6/6 (also known as Nylon 66, Nylon 6-6 or Nylon 6,6).

The bobbin 300 further includes a first connector rail 330 at the lower end of the first end flange 310 and a second connector rail 332 at the lower end of the second end flange 312. Each connector rail has a respective lower surface 334 and a respective upper surface 336. A plurality of connector pins 338 extend downwardly from the lower surfaces of the connector rails. Some or all of the connector pins are electrically connectable to the winding 326. The upper surfaces of the connector rails are aligned with the lower inner surface 322 of the passageway 320.

Unlike the previously described conventional bobbin 110, the bobbin 300 of FIGS. 4-8 includes a first ledge 340 that extends from the outer surface 314 of the first end flange 310 in parallel to the first connector rail 330. The first ledge 340 has a lower surface 342 that is aligned with the upper inner surface 324 of the passageway 320. The first ledge 340 has an upper surface 344, which is spaced apart from the lower surface 342 of the first ledge 340 by a ledge thickness. The lower surface 342 of the first ledge 340 is spaced apart from upper surface 336 of the first connector rail 330 to form a first horizontal channel 346 across the outer surface 314 of the first end flange 310. The first horizontal channel 346 is perpendicular to the passageway 320.

The bobbin 300 further includes a second ledge 350 that extends from the outer surface 316 of the second end flange 312 in parallel with the second connector rail 332. The second ledge 350 has a lower surface 352 that is aligned with the upper inner surface 324 of the passageway 320. The second ledge 350 has an upper surface 354, which is spaced apart from the lower surface 352 by the ledge thickness. The lower surface 352 of the second ledge 350 is spaced apart from upper surface 336 of the second connector rail 332 to form a second horizontal channel 356 across the outer surface of the second end flange 312. The second horizontal channel 356 is perpendicular to the passageway 320 and is parallel to the first horizontal channel 346.

In the illustrated embodiment, the ledge thickness of each of the first ledge 340 and the second ledge 350 is approximately 0.07 inch, and each of the ledges extend outward from the respective end flange by a length of approximately 0.143 inch. The thickness of each ledge with respect to the length is sufficient to cause the ledge to be substantially rigid such that the ledge does not flex when the cores are inserted as described below. In the illustrated embodiment, the respective lower surface of each ledge is spaced apart from respective upper surface of the connector rail by approximately 0.24 inch, which is the nominal height of each of the first channel 346 and the second channel 356.

As shown in FIGS. 4-8, a first plurality of ribs 360 extend outward from the outer surface 314 of the first end flange 310 and extend upward from the upper surface 336 of the first connector rail 330. A second plurality of ribs 362 extend outward from the outer surface 316 of the second end flange 312 and extend upward from the upper surface 336 of the second connector rail 332. A third plurality of ribs 364 extend outward from outer surface 314 of the first end flange 310 and extend downward from the lower surface 342 of the first ledge 340. A fourth plurality of ribs 366 extend outward from the outer surface 316 of the second end flange 312 and extend downward from the lower surface 352 of the second ledge 350. In the illustrated embodiment, each of the first, second, third and fourth plurality of ribs includes four ribs. Each plurality of ribs includes a pair of ribs positioned on either side of a respective end of the passageway 320 and includes a pair of ribs positioned along the edges of the respective first end flange.

In the illustrated embodiment, each of the ribs in the first, second, third and fourth plurality of ribs 360, 362, 364, 366 has approximately the same size and shape. One of the ribs 360 in the first plurality of ribs is shown in more detail in the enlarged perspective view of FIG. 5 and in an enlarged front elevational view of FIG. 6. As shown in FIGS. 5 and 6, the rib 360 may be a six-sided polyhedron having a first end face 370 (shown partially in dashed lines) in the shape of an isosceles trapezoid in the plane of the outer surface 314 of the first end flange 310. The first end face 370 has a longer base along the intersection of the upper surface 336 of the first connector rail 330 with the outer surface 314 of the first end flange 310. The longer base of the first end face 370 has a width of approximately 0.027 inch. The first end face 370 has a shorter base displaced away from the upper surface of the first connector rail. The shorter base of the first end face has a width of approximately 0.015 inch. The shorter base of the first end face 370 is spaced apart from the longer base by approximately 0.02 inch.

The rib 360 has a second trapezoidal end face 372 displaced away from the first end face 370 by approximately 0.0785 inch. In the illustrated embodiment, the second end face 372 is parallel to the first end face 370. However, the second end face 372 may also be at an angle with respect to the first end face 370. The second end face has a longer base along the upper surface 336 of the first connector rail 330. The longer base of the second end face 372 has a width of approximately 0.00875 inch. The second end face 372 has a shorter base displaced away from the upper surface 336 of the first connector rail 330. The shorter base of the second end face 372 has a width of approximately 0.005 inch. In the illustrated embodiment where the second end face is parallel to the first end face, the second base of the second end face is spaced apart from the first base by approximately 0.003 inch. The second end face is spaced apart from the first end face by the length of the rib, which is approximately 0.0785 inch in the illustrated embodiment.

The rib 360 has a base face 374 (shown partially in dashed lines), which is coplanar with the upper surface 336 of the first connector rail 330. The base face is defined by two lines connecting the ends of the longer base of the first end face 370 with the ends of the longer base of the second end face 372.

The rib 360 has an exposed engagement face 376, which has a first end 380 spaced apart from the base face 374 at the outer surface 314 of the first end flange 310 by the height of first end face 370. The engagement face 376 has a displaced second end 382, which is spaced apart from the base face 374 by the height of the second end face 372. In the illustrated embodiment, the engagement face 376 slopes upward from the second end to the first end face from approximately 0.003 inch above the upper surface 336 of the first connector rail 330 to approximately 0.02 inch above the upper surface of the first connector rail. Thus, the engagement face 376 slopes upward at an angle of approximately 12.22 degrees. The rib 360 has a first side face 384 and a second side face 386 (shown partially in dashed lines) that respectively interconnect a sloped side of the first end face with a corresponding sloped side of the second end face. The foregoing shapes and dimensions are provided for illustration only. The shapes and dimensions may vary in other embodiments.

Each of the other ribs in the first plurality of ribs 360 has a size and shape corresponding to the size and shape of the rib illustrated in FIGS. 5 and 6. The respective engagement faces 376 of the second plurality of ribs 362 also slope upward from the respective second end 382 to the respective first end 380. The respective engagement faces of the third plurality of ribs 364 and the fourth plurality of ribs 366 slope downward from the respective second ends to the respective first ends.

As illustrated in FIG. 4 and FIGS. 6-8, the ribs 360 on the upper surface 336 of the first connector rail 330 extend upward across the first channel 346 toward the ribs 364, which extend downward from the lower surface 342 of the first ledge 340. Similarly, the ribs 362 on the upper surface 336 of the second connector rail 332 extend upward across the second channel 356 toward the ribs 366, which extend downward from the lower surface 352 of the second ledge 350. As described above, the nominal height of the first channel 346 between the upper surface of the first connector rail and the lower surface of the first ledge is approximately 0.24 inch. Similarly, the nominal height of the second channel 356 between the upper surface of the second connector rail and the lower surface of the second ledge is also approximately 0.24 inch. The spacing between the lower ribs and the upper ribs at each end of the bobbin varies from the respective second ends 382 to the respective first ends 380 of the engagement faces 376 of the ribs. The combined heights of the second ends of the engagement faces of two opposing ribs cause the heights of the respective channels between the second ends of opposing ribs to be reduced to approximately 0.234 inch (e.g., $0.24-(2\times0.003)$). The combined heights of the first ends of the engagement faces of two opposing ribs cause the heights of the respective channels between the first ends of opposing ribs to be further reduced to approximately 0.2 inch (e.g., $0.24-(2\times0.02)$). The effect of the varying spacing between the engagement faces of the opposing ribs is described below.

Figure 9:
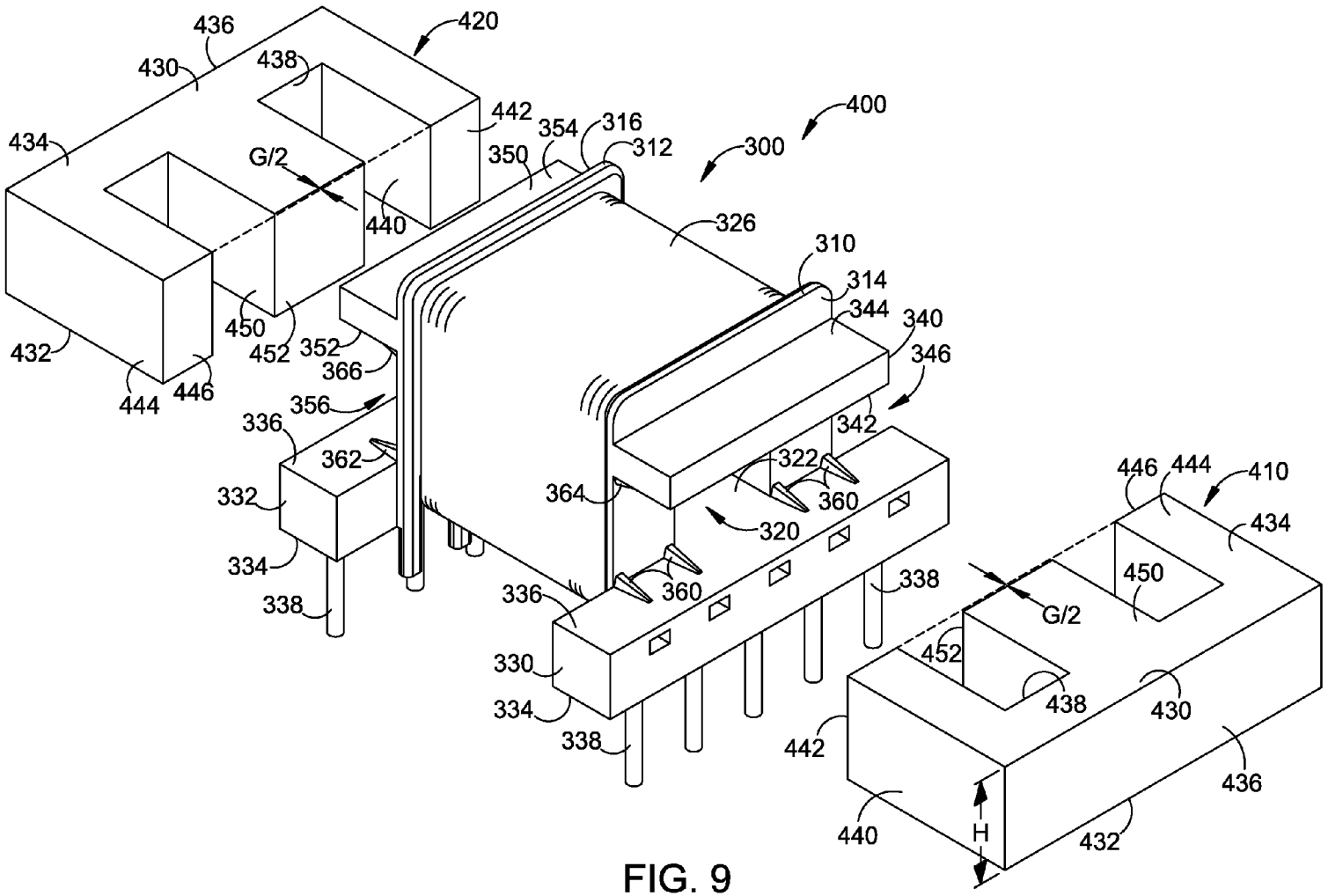
FIG. 9 illustrates an exploded perspective view of a magnetic assembly that incorporates that bobbin of FIGS. 4-8, the magnetic assembly of FIG. 9 including two E-cores to be inserted into the bobbin from opposite ends.
Figure 10:
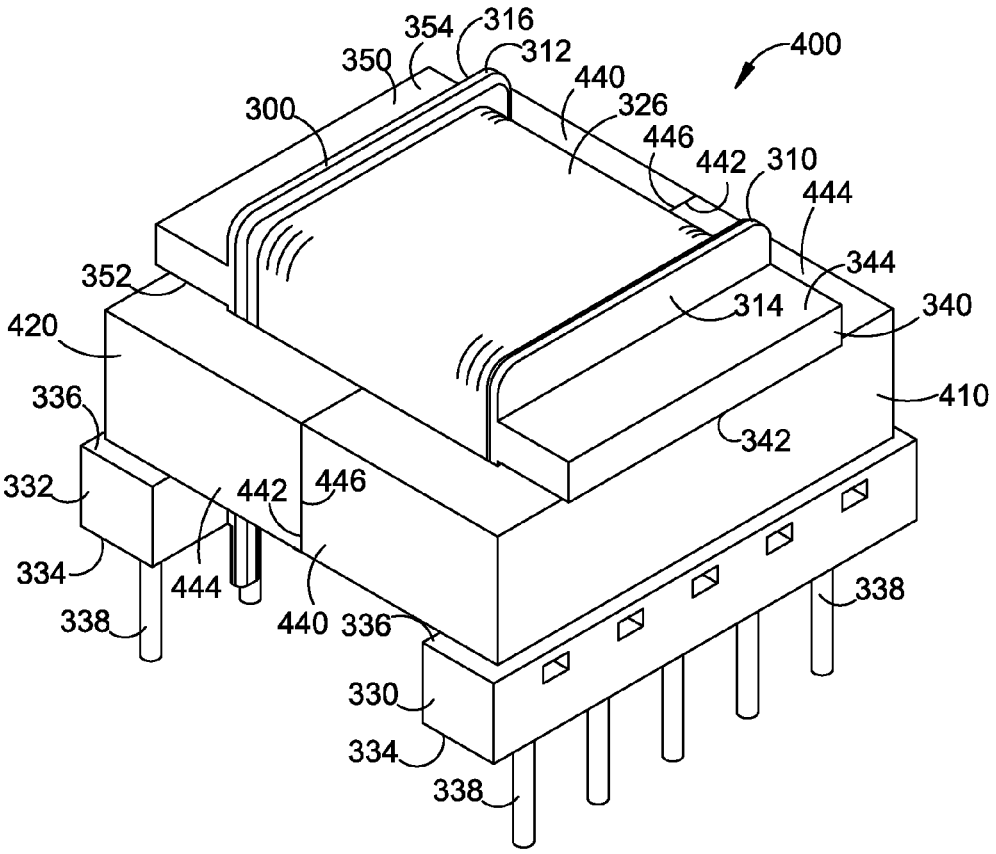
FIG. 10 illustrates a perspective view of the completed magnetic assembly of FIG. 9 with the two E-cores inserted into the bobbin and secured by the upper and lower ribs of the bobbin.
Figure 11:
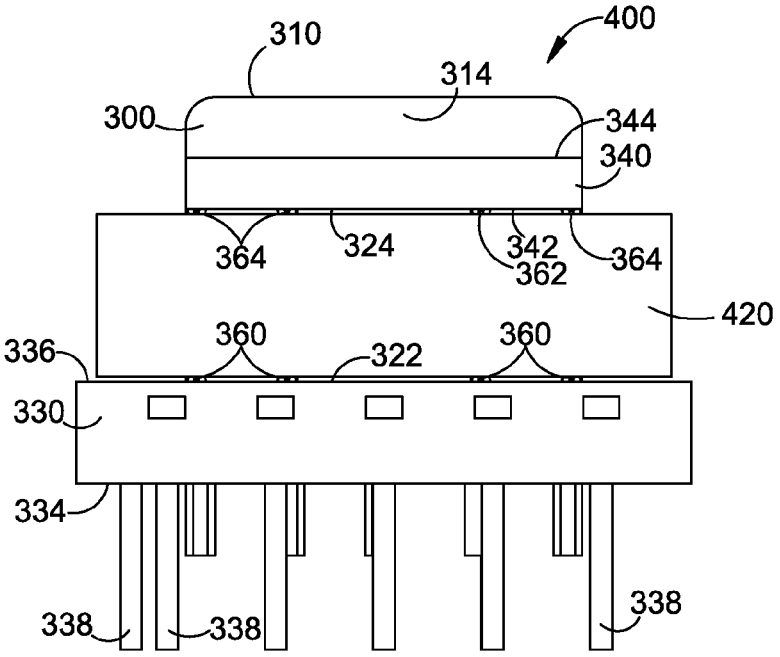
FIG. 11 illustrates a front elevational view of the magnetic assembly of FIG. 10.
Figure 12:
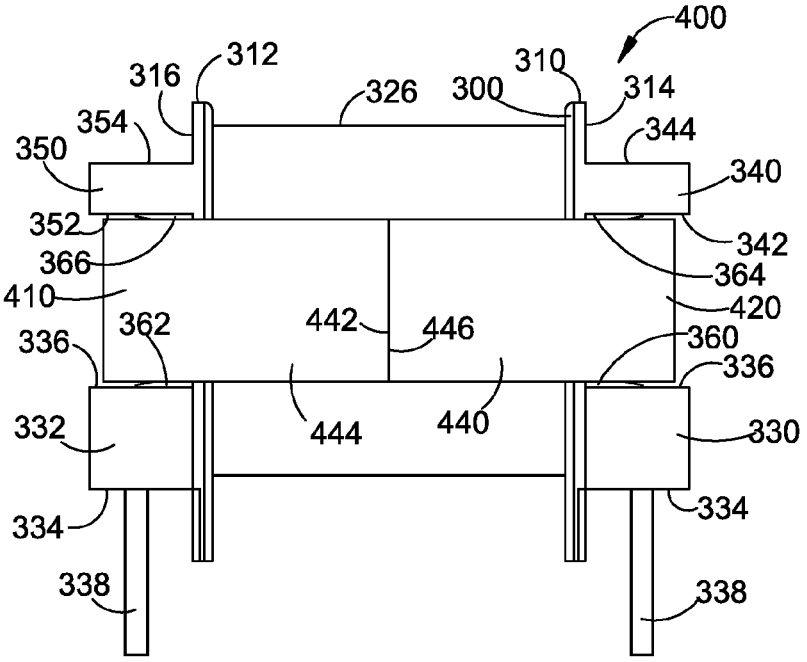
FIG. 12 illustrates a side elevational view of the magnetic assembly of FIG. 10.

FIG. 9 illustrates an exploded perspective view of a magnetic assembly 400 that incorporates that bobbin 300 of FIGS. 4-8. The magnetic assembly of FIG. 9 includes a first E-core 410 and a second E-core 420. FIG. 10 illustrates a perspective view of the magnetic assembly of FIG. 9 with the components fully assembled. FIG. 11 illustrates a front elevational view of the magnetic assembly of FIG. 10. FIG. 12 illustrates a side elevational view of the magnetic assembly of FIG. 10.

The first E-core 410 and the second E-core 420 are similar to the first and second E-cores 120, 122 described above with respect to FIGS. 1 and 2. In particular, each E-core includes a main body 430 having a lower surface 432 and an upper surface 434. The main body of each E-core has a height (H) of approximately 0.224 inch between the lower surface and the upper surface. The main body 430 also has an outer surface 436 and an inner surface 438. A first outer leg 440 extends from the inner surface of the main body 430. The first outer leg 440 has a first outer leg end surface 442. A second outer leg 444 extends from the inner surface of the main body. The second outer leg 444 has a second outer leg end surface 446. A center leg 450 extends from the inner surface 438 of the main body 430. The center leg 450 has a center leg end surface 452.

As discussed above, the outer legs preferably have the same length with respect to the inner surface of the main body. The center leg of one or both S-cores may be shorter than the outer legs by a small difference (e.g., G/2 in FIG. 9) to form a gap within the passageway when the respective first outer leg surface of each E-core is abutting the respective second outer leg surface of the other E-core. In the illustrated embodiment, a total gap distance (G) is provided between the center leg surfaces. For example, in one embodiment, the total gap distance may be approximately 0.001 inch. The gap controls core saturation in a known manner. In the illustrated embodiment, the three legs have respective lower and upper surfaces that are coplanar with the lower and upper surfaces of the main body. In alternative embodiments (not shown), the center leg may have one surface that is not coplanar with the other surfaces such that the center leg has a height less than the height of the outer legs.

In FIG. 9, the first E-core 410 is positioned with the respective center leg 450 aligned for insertion into the passageway 320 of the bobbin 300 at the first end flange 310. The second E-core 420 is positioned with the respective center leg 450 aligned for insertion into the passageway 320 of the bobbin 300 at the second end flange 312. It should be understood that the positions of the two E-cores are interchangeable in FIG. 9 and in FIGS. 10-12.

FIG. 10 illustrates a perspective view of the completed magnetic assembly 400 of FIG. 9. In FIG. 10, the center leg 450 of the first E-core 410 is inserted into the passageway 320 of the bobbin 300 until the main body 430 is within the first channel 346 and the inner surface 438 (FIG. 9) of the main body of the first E-core abuts the outer surface 314 of the first end flange 310. The main body of the first E-core is secured by the first plurality of ribs 360 and the third plurality of ribs 364 as described below. The center leg 450 of the second E-core 420 is inserted into the passageway 320 of the bobbin 300 until the main body 430 is within the second channel 356 and the inner surface 438 of the main body of the second E-core abuts the outer surface 316 of the second end flange 312. The main body of the second E-core is secured by the second plurality of ribs 362 and the fourth plurality of ribs 366 as described below.

As discussed above, the height of the main body 430 of the first E-core 410 is approximately 0.224 inch in the illustrated e embodiment. Thus, when the center leg 450 of the first E-core 410 is initially inserted into the passageway 320 of the bobbin 300, the main body of the first E-core 410 fits easily into the first channel 346 between the second ends 382 of the respective engagement surfaces 376 of the opposing lower ribs 360 and upper ribs 364 because the second ends are spaced apart by approximately 0.234 inch. As the center leg of the first E-core 410 is inserted farther into the passageway 320, the lower surface 432 of the main body engages the engagement surfaces of the lower ribs, and the upper surface 434 of the main body engages the engagement surfaces of the upper ribs. After engaging the engagement surfaces of the ribs, the upper and lower surfaces of the main body crush the resilient nylon ribs as the main body is forced into the channel. The main body is fully engaged with the ribs when the inner surface 438 of the main body abuts the outer surface 314 of the first end flange 310 of the bobbin proximate to the first ends 380 of the engagement surfaces of the ribs.

In like manner, the center leg 450 of the second E-core 420 is inserted into the passageway 320 of the bobbin 300, and the main body 430 of the second core is inserted into the second channel 356. The lower surface 432 and the upper surface 434 of the main body of the second E-core are forced into frictional engagement with the engagement surfaces 376 of the lower ribs 362 and the upper ribs 366 which extend into the second channel as described above.

The lengths of the outer legs 440, 444 of the two E-cores 410, 420 are selected so that the first and second end surfaces 442, 446 of the outer legs of the first E-core abut the second and first end surfaces 442, 446 of the outer legs of the second E-core when the respective inner surfaces 438 of the main bodies 430 are fully engaged with the ribs 360, 362, 364, 366 of the end flanges 310, 312 of the bobbin 300. The frictional engagements of the crushed ribs with the upper surface 334 and lower surface 332 of the main bodies of the two E-cores secure the E-cores in fixed spatial relationships with the bobbin without requiring tape, glue or other additional attachment materials.

Figure 13:
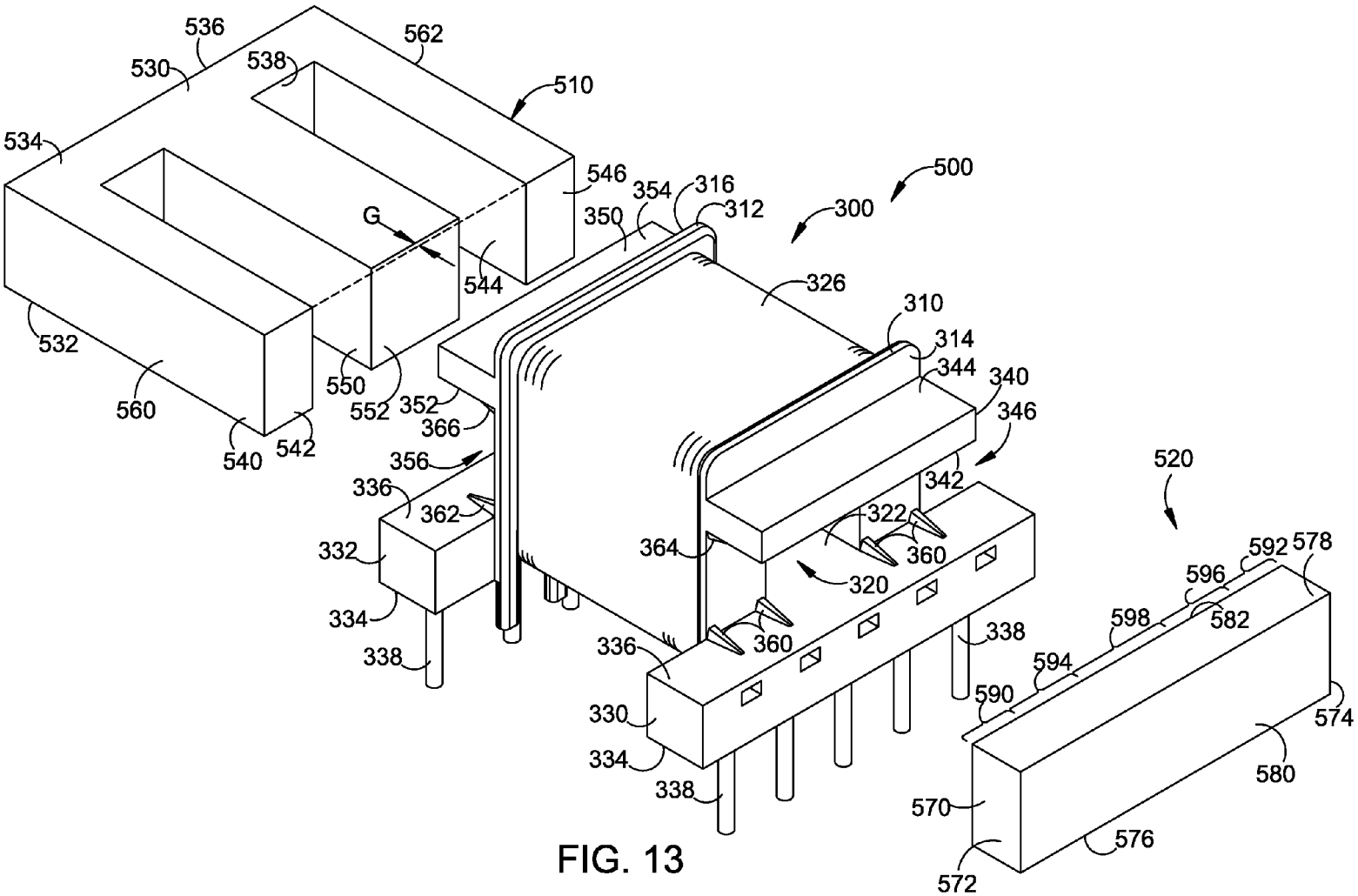
FIG. 13 illustrates an exploded perspective view of a magnetic assembly that incorporates that bobbin of FIGS. 4-8, the magnetic assembly of FIG. 13 including one extended E-core positioned to be inserted into the channel at the second end of the bobbin and an I-core positioned to be inserted into the channel at the first end of the bobbin.
Figure 14:
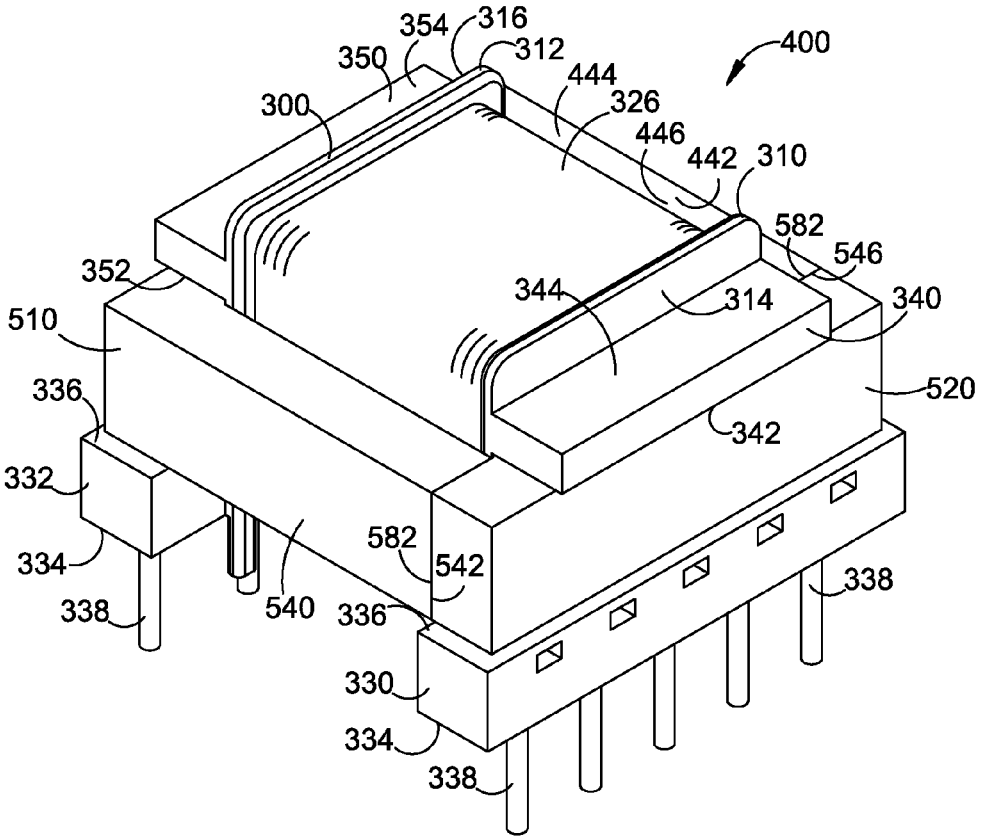
FIG. 14 illustrates a perspective view of the completed magnetic assembly of FIG. 13 with the extended E-core inserted into the channel at the second end of the bobbin and secured by the upper and lower ribs at the second end of the bobbin and with the I-core positioned in the channel at the first end of the bobbin and secured by the upper and lower ribs at the first end of the bobbin.
Figure 15:
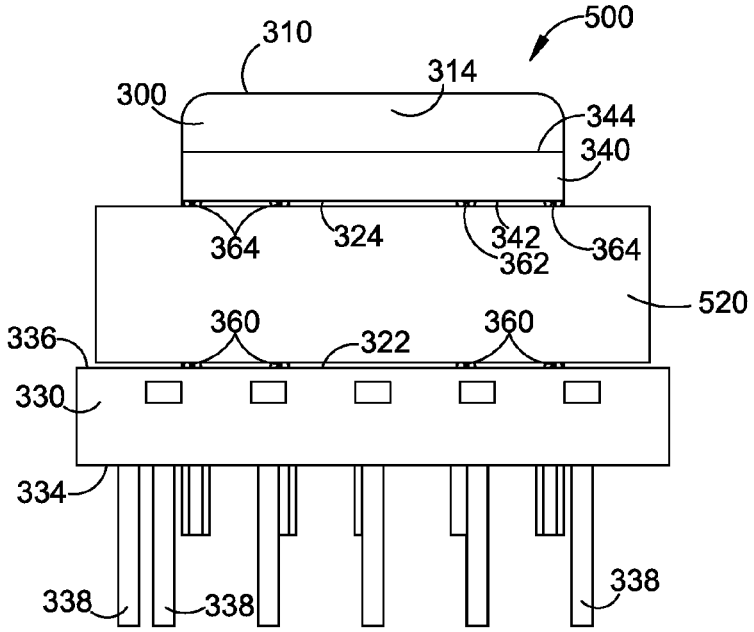
FIG. 15 illustrates a front elevational view of the magnetic assembly of FIG. 14.
Figure 16:
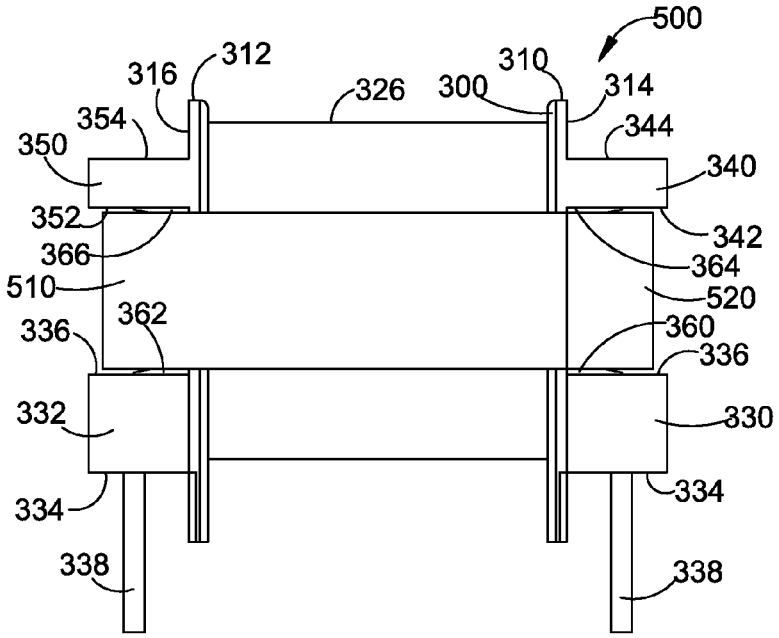
FIG. 16 illustrates a side elevational view of the magnetic assembly of FIG. 14.

FIG. 13 illustrates an exploded perspective view of a magnetic assembly 500 that incorporates that bobbin 300 of FIGS. 4-8. The magnetic assembly of FIG. 13 includes one extended E-core 510 to be inserted into the passageway 320 at the end of the bobbin proximate to the second flange 312. The magnetic assembly 500 includes an I-core 520 positioned at the opposite end of the bobbin 300 proximate to the first flange 310. FIG. 14 illustrates a perspective view of the completed magnetic assembly of FIG. 13. FIG. 15 illustrates a front elevational view of the magnetic assembly of FIG. 14. FIG. 16 illustrates a side elevational view of the magnetic assembly of FIG. 14. In FIGS. 13-16, the extended E-core 510 is positioned proximate to the second end flange 312, and the I-core 520 is positioned proximate to the first end flange 310. The positions of the E-core and the I-core can be interchanged or the identifications of the first and second end flanges can be interchanged without affecting the magnetic properties of the structure.

The extended E-core 510 of FIG. 13 is similar to the previously described E-cores. However, the extended E-core has outer legs with lengths selected so that the outer legs of the extended E-core 510 extend for the length of the bobbin 300. The extended E-core has a main body 530, which has a lower surface 532, an upper surface 534, an outer surface 536 and an inner surface 538. A first outer leg 540 extends perpendicularly from the main body 530 to a first outer leg end surface 542. A second outer leg 544 extends from the main body 530 to a second outer leg end surface 546. A center leg 550 extends from the main body 530 to a center leg end surface 552. The outer legs and the center leg have respective lower and upper surfaces that are coplanar with the lower and upper surfaces of the main body 530. The extended E-core 510 has a height between the lower surface and the upper surface of the main body that corresponds to the heights of the previously described E-cores 410, 420. The extended E-core 510 has a width between an outer surface 560 of the first outer leg 540 and an outer surface 562 of the second outer leg 544.

The first outer leg 540 has a length from the inner surface 538 of the main body 530 to the first outer leg end surface 542 that is substantially equal to the length of the passageway 320 of the bobbin 300 from the outer surface 316 of the second end flange 312 to the outer surface 314 of the first end flange 310. Thus, when the center leg 550 is inserted into the passageway 320 and the main body 530 is inserted into the second channel 356, the inner surface of the main body abuts the outer surface 316 of the second end flange 314 as shown in FIG. 14, and the first outer leg end surface is flush with the outer surface 314 of the first end flange 310. The second outer leg 544 has a corresponding length such that the second outer leg end surface 546 is also flush with the outer surface of the first end flange. The length of the center leg is shorter than the lengths of the two outer legs by a distance G such that the center leg end surface 552 is recessed slightly with respect to the outer surface of the first end flange. For example, in the illustrated embodiment, the distance G is approximately 0.01 inch.

The I-core 520 is a rectangular parallelepiped having only a main body 570. The main body 570 has a first end surface 572 and a second end surface 574. The main body 570 of the I-core 520 has a length between the first end surface 572 and the second end surface 574 corresponding to the width of the extended E-core 510 between the outer surfaces 560, 562 of the outer legs 540, 544. The I-core 520 has a height between a lower surface 576 and an upper surface 578. In the illustrated embodiment, the height of the I-core 520 is substantially the same as the height of the extended E-core 510. The I-core 520 has an outer surface 580 and an inner surface 582.

As shown in FIG. 14, the I-core 520 is mounted on the bobbin 300 with a first portion 590 of the inner surface 582 of the I-core abutting the first outer leg end surface 542 of the E-core 510 and with a second portion 592 of the inner surface of the I-core abutting the second outer leg end surface 546 of the E-core. A third portion 594 of the inner surface of the I-core abuts the outer surface 314 of the first end flange 310 between the passageway 320 of the bobbin and the first outer leg 540 of the E-core 510. A fourth portion 596 of the inner surface of the I-core abuts the outer surface 314 of the first end flange 310 between the passageway 320 and the second outer leg 544 of the E-core 510. Accordingly, a fifth portion (central facing surface) 598 of the inner surface of the I-core is spaced apart from the recessed center leg end surface 552 by the difference in length of the center leg with respect to the lengths of the two outer legs of the E-core (e.g., the distance G shown in FIG. 13). The spacing produces a magnetic gap between the end surface of the center leg of the E-core and the central facing surface of the I-core. The gap controls saturation of the core in a known manner.

As shown in FIG. 14, the main body 530 of the extended E-core 510 is positioned in the second channel 356 between the second connector rail 332 and the second ledge 350 with the inner surface 538 of the main body adjacent to the outer surface 316 of the second end flange 312, as described above. The extended E-core is secured to the second end flange by the friction caused by the crushed second plurality of ribs 362 and the crushed fourth plurality of ribs 366.

As further shown in FIG. 14, the main body 570 of the I-core 520 is positioned in the first channel 346 between the first connector rail 330 and the first ledge 340 with the inner surface 582 of the main body of the I-core adjacent to the outer surface 314 of the first end flange 310. The I-core 520 is secured to the first end flange 310 by the friction caused by the crushed first plurality of ribs 360 and the crushed third plurality of ribs 364.

Although described above in the context of the illustrated embodiments, it should be understood that the core retention ribs can also be used with bobbins and cores of different configurations. For example, the center legs of the two E-cores of FIGS. 9-12 or the center leg of the E-core of FIGS. 13-16 and the corresponding passageway through the bobbin may be round in alternative embodiments. The improved bobbin can be modified such that the passageway accommodates a center leg having a shorter height than the heights of the main body and the outer legs to produce a low-profile magnetic assembly.

Although illustrated by four crushable ribs above and four crushable ribs below the cores, additional or fewer ribs can be used in alternative embodiments. Furthermore, the opposing ribs in each channel may be offset rather than directly across from each other.

Although there have been described particular embodiments of the present invention of a new and useful "Bobbin and E-Core Assembly Configuration and Method for E-Cores and EI-Cores," it is not intended that such references be construed as limitations upon the scope of this invention except as set forth in the following claims.

What is claimed is:

1. A magnetic assembly comprising:

a bobbin comprising a first outer flange, a second outer flange, a passageway extending through the bobbin from the first outer flange to the second outer flange, and at least one winding wound about the passageway, the bobbin further comprising a first channel extending from the first outer flange and a second channel extending from the second outer flange, the bobbin further comprising a first plurality of crushable ribs extending outward from the first outer flange into the first channel and a second plurality of crushable ribs extending outward from the second outer flange into the second channel;

a first core having a main body, a first outer leg, a second outer leg, and a center leg extending from the main body, the center leg having an end surface, the center leg of the first core positioned in the passageway of the bobbin with at least a portion of the main body of the core positioned in the first channel in crushing frictional engagement with the first plurality of ribs to crush at least a portion of each rib to increase friction between the main body of the first core and the ribs to thereby secure the first core to the bobbin; and a second core having a main body, at least a portion of the main body of the second core positioned in the second channel in crushing frictional engagement with the second plurality of crushable ribs to crush at least a portion of each rib to increase friction between the main body of the second core and the ribs to thereby secure the second core to the bobbin, a facing surface of the second core positioned proximate to the end surface of the center leg of the first core.

2. The magnetic assembly as defined in claim 1, wherein the second core is an I-core.

3. The magnetic assembly as defined in claim 1, wherein:

the second core is an E-core having a first outer leg, a second outer leg, and a center leg; and the facing surface of the second core is an end surface of the center leg of the second core.

4. The magnetic assembly as defined in claim 1, wherein each crushable rib has a first thickness at a first end proximate to the respective outer flange and has a second thickness at a second end displaced away from the respective outer flange, the second thickness less than the first thickness, the crushable rib having an engagement surface that slopes between the first end and the second end, the engagement surface engaging the main body of the respective core.

5. The magnetic assembly as defined in claim 1, wherein the first plurality of crushable ribs includes at least a first rib positioned above the main body of the first core and a second rib positioned below the main body of the first core, the first and second ribs spaced apart vertically such that the respective second ends of the first and second ribs are spaced apart by a distance greater than the height of the main body of the first core and the respective first ends of the first and second ribs are spaced apart by a distance less than the height of the main body of the first core.

6. The magnetic assembly as defined in claim 5, wherein:

the first rib is positioned on a lower surface of a ledge extending from the first outer flange; and the second rib is positioned on an upper surface of a connector rail.

7. A bobbin for a magnetic assembly comprising:

a first outer flange and a second outer flange;

a passageway extending through the bobbin from the first outer flange to the second outer flange, the passage way having a lower surface and an upper surface;

a first connector rail extending outwardly from the first flange below the lower surface of the passageway;

a first ledge extending outwardly from the first flange above the upper surface of the passageway;

a second connector rail extending outwardly from the second flange below the lower surface of the passageway;

a second ledge extending outwardly from the second flange above the upper surface of the passageway at least one winding wound about the passageway;

a first plurality of crushable ribs extending outward from the first outer flange, at least a first of the first plurality of crushable ribs mounted on the first ledge and positioned at a level near the top of the passageway, and at least a second of the first plurality of crushable ribs mounted on the first connector rail positioned at a level near the bottom of the passageway; and a second plurality of crushable ribs extending outward from the second outer flange, at least a first of the second plurality of crushable ribs mounted on the second ledge and positioned at a level near the top of the passageway, and at least a second of the second plurality of crushable ribs mounted on the second connector rail and positioned at a level near the bottom of the passageway.

8. A method of assembling a magnetic assembly comprising:

positioning the center leg of an E-core into a passageway of a bobbin with a first outer leg of the E-core positioned on a first side of the bobbin, with a second outer leg of the E-core positioned on a second side of the bobbin, and with a main body of the E-core positioned in a first channel between upper and lower crushable ribs extending from a first end flange of the bobbin, the main body of the E-core crushing at least a portion of each rib to increase the friction between the main body of the E-core and the ribs to cause the crushable ribs to frictionally engage the main body to thereby secure the first E-core to the bobbin; and positioning a second core on the bobbin with at least a portion of a main body of the second core positioned in a second channel between upper and lower crushable ribs extending from a second end flange of the bobbin, the portion of the main body of the second core crushing at least a portion of each rib to increase the friction between the main body of the second core and the ribs to cause the crushable ribs to frictionally engage the portion of the main body of the second core to thereby secure the second core to the bobbin.

9. The method of assembling a magnetic assembly as defined in claim 8, wherein the E-core is a first E-core and wherein the second core is a second E-core, the second E-core having a center leg, the method further comprising positioning the center leg of the second E-core in the passageway of the bobbin, the center leg of the second E-core having an end surface, the end surface of the center leg of the second E-core spaced apart from an end surface of the center leg of the first E-core to form a magnetic gap.

10. The method of assembling a magnetic assembly as defined in claim 8, wherein:

the E-core is an extended E-core having outer legs that extend from the first end flange to the second end flange of the bobbin and having a center leg positioned in the passageway with an end surface of the center leg near the second end flange, and the second core is an I-core; and the method further comprising positioning a facing surface of the main body of the I-core proximate to and spaced apart from the end surface of the center leg of the extended E-core to form a magnetic gap.

* * * * *